US010477303B1

(12) United States Patent
Kapolnek et al.

(10) Patent No.: US 10,477,303 B1
(45) Date of Patent: Nov. 12, 2019

(54) ADJUSTABLE POSITIONING HEAD RESTRAINT SPEAKERS

(71) Applicant: GM Global Technology Operations LLC, Detroit, MI (US)

(72) Inventors: Gerard Kapolnek, Carleton, MI (US); Chad C. Cairns, Oakland Township, MI (US); Daniel W. Booth, Troy, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/141,186

(22) Filed: Sep. 25, 2018

(51) Int. Cl.
*H04R 1/40* (2006.01)
*H04R 1/02* (2006.01)

(52) U.S. Cl.
CPC ..... *H04R 1/403* (2013.01); *H04R 1/025* (2013.01); *H04R 2499/13* (2013.01)

(58) Field of Classification Search
CPC ..... H04R 1/026; H04R 1/323; H04R 3/00; H04R 1/025; H04R 1/403; H04B 1/082
USPC ..... 381/86, 332, 334, 94.1, 89
See application file for complete search history.

(56) References Cited

U.S. PATENT DOCUMENTS 6,234,446 B1 * 5/2001 Patterson ..... B64D 11/0015 224/201
9,998,818 B1 * 6/2018 Mitchell ..... H04R 1/1025

* cited by examiner

*Primary Examiner* — Thjuan K Addy

(57) ABSTRACT

An adjustable positioning head restraint speaker system includes a head restraint unit mounted to a vehicle seat. A left-side speaker unit and a right-side speaker unit are each manually displaced with respect to the head restraint unit to independently position each of the left-side speaker unit and the right-side speaker unit in different temporarily fixed locations with respect to the head restraint unit. A member connects the left-side speaker unit and the right-side speaker unit to one of the head restraint unit and the vehicle seat. The different temporarily fixed locations include at least a first location creating a direct acoustic path into an ear of an occupant of the vehicle seat and a second location defining an indirect acoustic path toward the ear of the occupant.

20 Claims, 10 Drawing Sheets

ADJUSTABLE POSITIONING HEAD RESTRAINT SPEAKERS

INTRODUCTION

The present disclosure relates to speaker systems provided in a seat head restraint for drivers and passengers of a vehicle.

Vehicles such as automobile vehicles, sport utility vehicles, trucks, vans, and the like commonly provide radio and other sound system output to vehicle occupants which may include providing speakers mounted in a head restraint of a vehicle seat system. Known head restraint mounted speakers are commonly provided directly in the head restraint, for example directing sound laterally to the sides of the head restraint proximate to left and right ears of a vehicle occupant. This speaker positioning has drawbacks related to sound quality as the speakers are directed toward but are not positionable directly at the ear or ears of the occupant. Speaker output therefore must be "directed" toward the occupant's ears but may lack sound quality due to dispersion or interference from other speakers or from sound generated by vehicle travel, highway sounds, and other occupants.

Thus, while current vehicle speaker systems achieve their intended purpose, there is a need for a new and improved system and method for directing speaker output to the intended ears of a specific vehicle occupant.

SUMMARY

According to several aspects, an adjustable positioning head restraint speaker system includes a head restraint unit mounted to a vehicle seat. A speaker unit is connected to one of the head restraint unit and the vehicle seat, the speaker unit manually displaced with respect to the head restraint unit to position the speaker unit in different temporarily fixed locations with respect to the head restraint unit.

In another aspect of the present disclosure, a flexible member connecting the speaker unit to the head restraint unit.

In another aspect of the present disclosure, the head restraint unit is mounted to the vehicle seat using a head restraint post; and wherein the flexible member is releasably engaged to the head restraint post using a lock unit.

In another aspect of the present disclosure, the lock unit includes a mechanical member engaging the lock unit to the head restraint post.

In another aspect of the present disclosure, the lock unit is movable in each of a first direction and an opposite second direction along the head restraint post independently of movement of the head restraint post.

In another aspect of the present disclosure, the flexible member defines a flexible cable having a hollow passageway through which a wiring harness extends, the wiring harness providing power and acoustic signals to the speaker unit.

In another aspect of the present disclosure, the flexible member defines a multiple segmented arm, with a speaker of the speaker unit positioned at least partially within the arm, and having the arm defining a portion of an air chamber of the speaker.

In another aspect of the present disclosure, the flexible member defines a hinge connected to a mounting plate, the mounting plate connected to a surface of the head restraint unit.

In another aspect of the present disclosure, the speaker unit slidably manually extends forward and rearward with respect to a speaker housing, the speaker housing connected by a strap to the head restraint unit to fix the speaker housing on a side of the head restraint unit such that the speaker unit when extended from the speaker housing is positioned proximate to an ear of an occupant of the vehicle seat.

In another aspect of the present disclosure, the speaker unit defines a speaker flap connected to an envelope cover, wherein the envelope cover extends around the head restraint unit and is releasably connected to the head restraint unit using at least one strap, the speaker flap moving between a stored position to an extended listening position.

In another aspect of the present disclosure, the speaker unit includes at least one local occupant control feature for control of at least one of an audio volume, noise cancellation, and an on/off function.

In another aspect of the present disclosure, the speaker unit includes a battery storage segment having a battery providing power for operation of the speaker unit.

According to several aspects, an adjustable positioning head restraint speaker system includes a head restraint unit mounted to a vehicle seat. A first speaker unit and a second speaker unit are each manually displaced with respect to the head restraint unit to independently position each of the first speaker unit and the second speaker unit in different temporarily fixed locations with respect to the head restraint unit. A support member connects the first speaker unit and the second speaker unit to one of the head restraint unit and the vehicle seat. A power supply provides power to the first speaker unit and the second speaker unit the member.

In another aspect of the present disclosure, the first speaker unit and the second speaker unit are connected to a mounting plate which is fixed to a bottom surface of the head restraint unit.

In another aspect of the present disclosure, the first speaker unit and the second speaker unit are connected to a mounting plate which is fixed to an upper surface of the vehicle seat.

In another aspect of the present disclosure, the power supply defines a wiring harness providing wires for each of speaker power and audio signal transfer, the wiring harness at least partially supported by the support member.

In another aspect of the present disclosure, the power supply defines a battery locally stored in at least one of the first speaker unit and the second speaker unit.

According to several aspects, an adjustable positioning head restraint speaker system includes a head restraint unit mounted to a vehicle seat. A left-side speaker unit and a right-side speaker unit are each manually displaced with respect to the head restraint unit to independently position each of the left-side speaker unit and the right-side speaker unit in different temporarily fixed locations with respect to the head restraint unit. A member connects the left-side speaker unit and the right-side speaker unit to one of the head restraint unit and the vehicle seat. The different temporarily fixed locations include at least a first location creating a direct acoustic path into an ear of an occupant of the vehicle seat and a second location defining an indirect acoustic path toward the ear of the occupant.

In another aspect of the present disclosure, at least one head restraint post connecting the head restraint unit to the vehicle seat. A flexible member connects the speaker unit to the head restraint post. The flexible member defines a flexible cable having a hollow passageway through which a wiring harness extends, the wiring harness providing power and acoustic signals to the speaker unit.

In another aspect of the present disclosure, the wiring harness extends through the head restraint post to a connector fixed to the head restraint post, the connector providing an exit aperture through a wall of the head restraint post through which the wiring harness extends into the hollow passageway of the flexible member.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
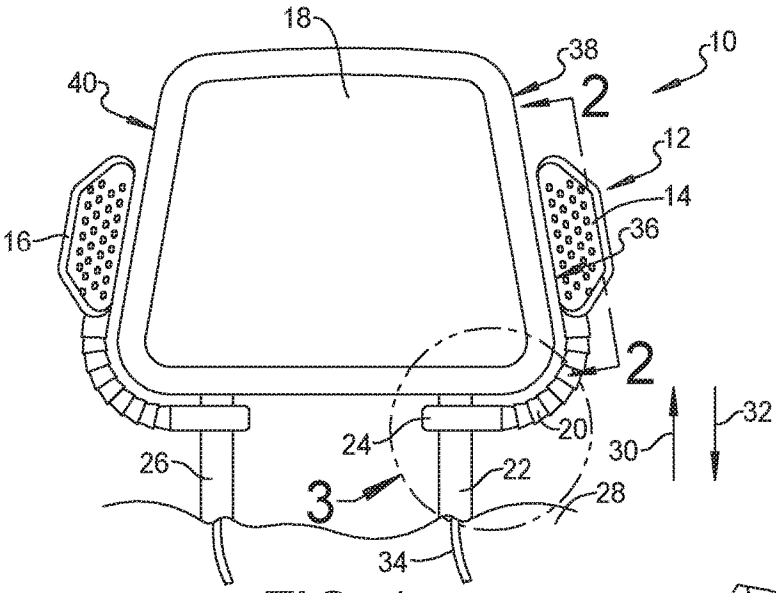
FIG. 1 is a front elevational view looking rearward of an adjustable positioning head restraint speaker system according to an exemplary embodiment.

Referring to FIG. 1, an adjustable positioning head restraint speaker system 10 provides an occupant adjustably positioned speaker system 12 having a left-side speaker unit 14 and an oppositely positioned right-side speaker unit 16, each position adjustable by an occupant of a vehicle for optimum sound quality. The speaker system 12 is mounted to a head restraint unit 18 which includes a head restraint member which is typically a padded or material covered member which is adjustable upward and downward with respect to a vehicle seat, commonly using head restrain posts described below. According to several aspects, each of the speaker units including the left-side speaker unit 14 and the right-side speaker unit 16 is connected to the head restraint unit 18 and manually displaced with respect to the head restraint unit 18 to position the speaker units in different temporarily fixed locations with respect to the head restraint unit 18 such as a stowed position and one or more listening positions.

Each of the left-side speaker unit 14 and the right-side speaker unit 16 are connected in a similar manner, therefore the following discussion of the left-side speaker unit 14 applies equally to the right-side speaker unit 16. The left-side speaker unit 14 is connected by a flexible cable 20 to a first head restraint post 22 using a lock unit 24. The right-side speaker unit 16 is similarly connected to a second head restraint post 26. Each of the first head restraint post 22 and the second head restraint post 26 are slidably disposed into a vehicle seat 28. The lock unit 24 is adjustably mounted which will be described in greater detail in reference to FIG. 3 such that the lock unit 24 is movable in each of first or an upward direction 30 and an opposite second or downward direction 32 independently of the movement of the head restraint post 22.

According to several aspects, each of the left-side speaker unit 14 and the right-side speaker unit 16 may be powered locally by one or more batteries and may receive signals wirelessly, or may be powered using a vehicle power supply by a wiring harness 34 which can extend through one or both of the first head restraint post 22 and the second head restraint post 26 and receive signals via the wiring harness 34. According to several aspects, each of the each of the left-side speaker unit 14 and the right-side speaker unit 16 may be left and right "handed", having for example a generally planar inward directed face 36 that permits the individual speaker unit to closely abut either a left-side wall 38 or a right-side wall 40 of the head restraint unit 18.

Referring to FIG. 2 and again to FIG. 1, each of the left-side speaker unit 14 and the right-side speaker unit 16 includes a speaker housing 42 containing a speaker 44 which is provided with a protective speaker grill 46. The speaker grill 46 may be fixed to or releasably snap-fit into an adapter 48 of the speaker housing 42. The left-side speaker unit 14 and the right-side speaker unit 16 are adjustably positioned by the occupant of the vehicle seat 28 to comfortably position each speaker grill 46 as close as desired to one of the ears of the occupant by flexing the flexible cable 20.

Figure 2:
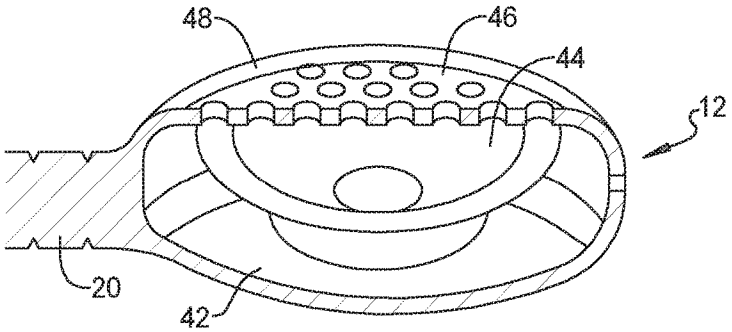
FIG. 2 is a partial cross sectional side elevational view taken at section 2 of FIG. 1.

Referring to FIG. 3 and again to FIGS. 1 and 2, according to several aspects each lock unit 24 can be releasably fixed in a desired position along a length of the first head restraint post 22 (shown) or the second head restraint post 26 (shown in FIG. 1) to change a position of the left-side speaker unit 14 or the right-side speaker unit 16. Each lock unit 24 includes an adjustment feature 50 such as a nut which according to several aspects can include an Allen nut. The adjustment feature 50 can be tightened or loosened using a tool 52 such as an Allen wrench allowing the lock unit 24 to be moved in either the first or upward direction 30 or the opposite second or downward direction 32.

Figure 3:
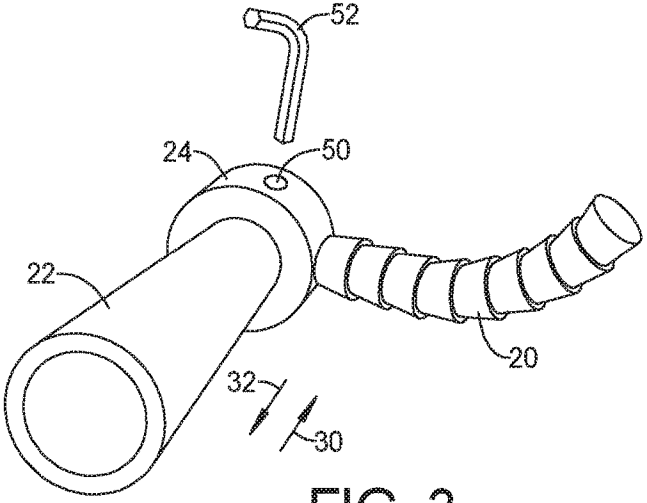
FIG. 3 is a bottom perspective view of area 3 of FIG. 1.

Referring to FIG. 4 and again to FIGS. 1 through 3, each of the left-side speaker unit 14 (shown) and the right-side speaker unit 16 of the speaker system 12 includes local control features. These can include but are not limited to a power button 54 and a switch 56 which controls operation of a wireless technology standard for exchanging data over short distances for example using short-wavelength ultra-high frequency radio waves in the approximate 2.4 GHz band.

Figure 5:
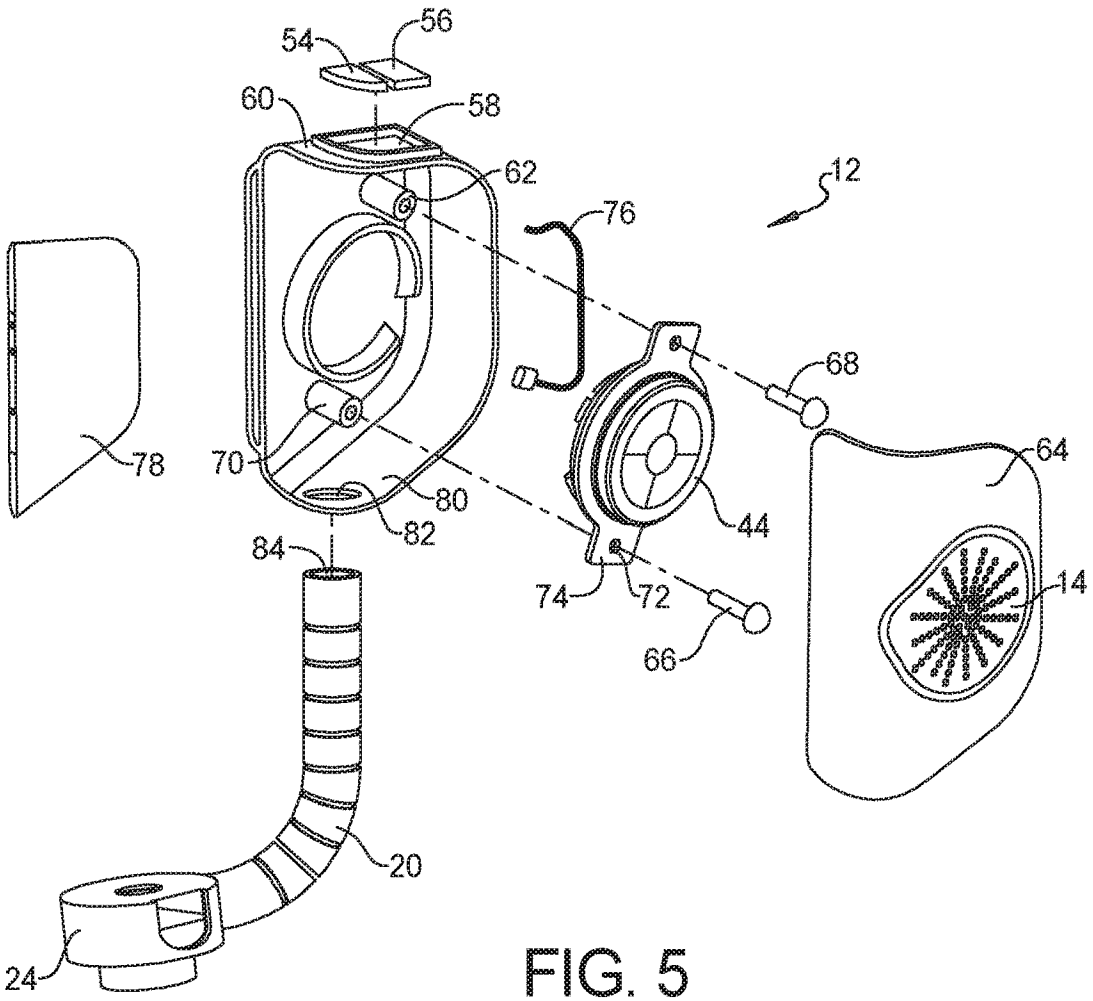
FIG. 5 is an exploded assembly view of the speaker unit of FIG. 4.
Figure 4:
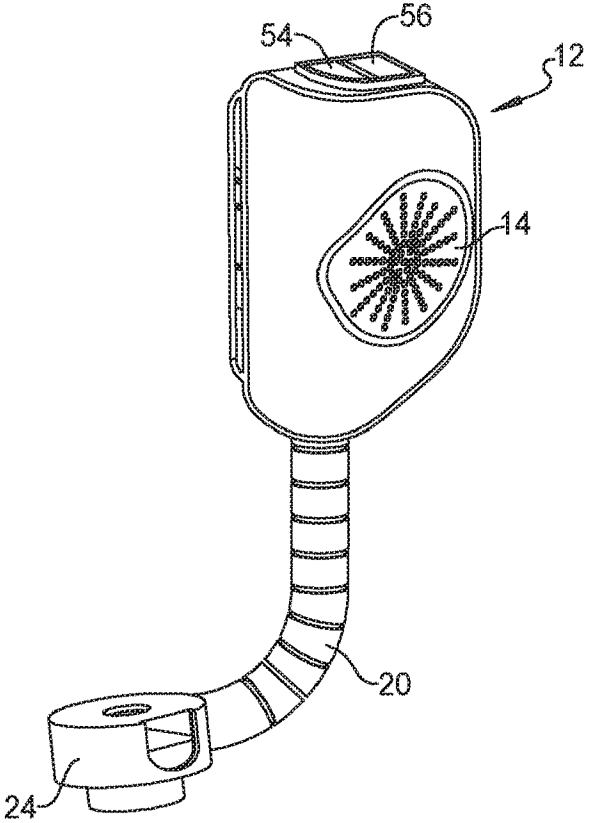
FIG. 4 is a front elevational view of a speaker unit of FIG. 1.

Referring to FIG. 5 and again to FIG. 4, the left-side speaker unit 14 (shown) is common to the right-side speaker unit 16, therefore the following discussion applied equally to the right-side speaker unit 16. The power button 54 and the switch 56 are positioned in a cavity 58 created in an outer wall 60 of a speaker housing 62. According to several aspects, the speaker housing 62 is made of a polymeric material such as an injection molding plastic. A speaker grill 64 also made of the polymeric material of the speaker housing 62 encloses the speaker 44 within the speaker housing 62, with the speaker 44 fixed for example using fasteners 66, 68 connected to individual fastener receiving posts co-molded with the speaker housing 62 such as a fastener receiving post 70. Each of the speakers 44 includes mounting features such as opposed flanges 72 with fastener receiving apertures 74. A wiring harness 76 can also be provided if power is supplied by a battery 78 positioned in the speaker housing 62 to power the speaker 44. A lower wall 80 of the speaker housing 62 can include a through aperture 82 to communicate with a vehicle supplied wiring harness, such as the wiring harness 34 described in reference to FIG. 1, which allows the wiring harness 34 to extend into the speaker housing 62 from an inner bore 84 of the flexible cable 20 aligned with the aperture 82.

Referring to FIG. 6 and again to FIG. 1, according to several aspects an adjustable positioning head restraint speaker system 86 is modified from the adjustable positioning head restraint speaker system 10, and includes a left-side speaker unit 88 and an opposed right-side speaker unit 90 in place of the left-side speaker unit 14 and the right-side speaker unit 16. Each of the left-side speaker unit 88 and the right-side speaker unit 90 slidably extend forward and rearward with respect to opposed speaker housings 92, 94 respectively. Sliding motion can be achieved by known methods such as flexible and extendable connection wires, extendable and retractable electrical contacts, wireless interface, and the like which are therefore not further described herein. The speaker housings 92, 94 are both interconnected by a mounting strap 96 which used to fix the speaker housings 92, 94 on opposite sides of a head restraint 98. Each of the left-side speaker unit 88 and the right-side speaker unit 90 can be independently displaced, for example in an extension direction 100 away from a front face 102 of the head restraint 98. Each of the left-side speaker unit 88 and the right-side speaker unit 90 includes a speaker 105 directed toward an occupant's head (not shown in this view) positioned proximate to the front face 102 of the head restraint 98.

Figure 6:
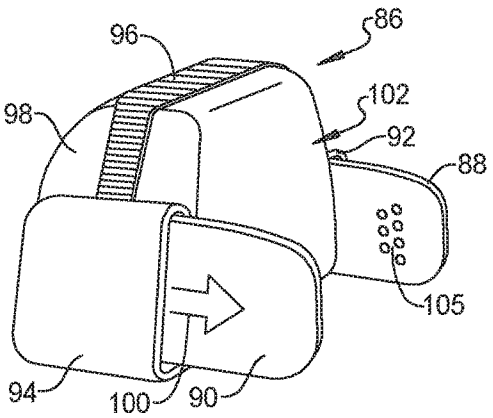
FIG. 6 is a right side elevational perspective view of an adjustable positioning head restraint speaker system according to another aspect.

Referring to FIG. 7 and again to FIGS. 1 and 6, according to several aspects an adjustable positioning head restraint speaker system 104 is modified from the adjustable positioning head restraint speaker systems 10 and 86. The adjustable positioning head restraint speaker system 104 provides a first speaker flap 106 and an oppositely facing second speaker flap 118 which are both sewn into an envelope cover 108. The envelope cover 108 extends around a head restraint 110 and is releasably connected to the head restraint 110 using a first strap 112 and a second strap 114 each having a buckle 116 to adjust tension on the first strap 112 and the second strap 114 to mount the envelope cover 108. Each of the first speaker flap 106 and the second speaker flap 118 rotate in an arc of rotation 120 between a stored position shown for the second speaker flap 118 to an extended listening position shown for the first speaker flap 106, and oppositely to return to the stored position.

Figure 7:
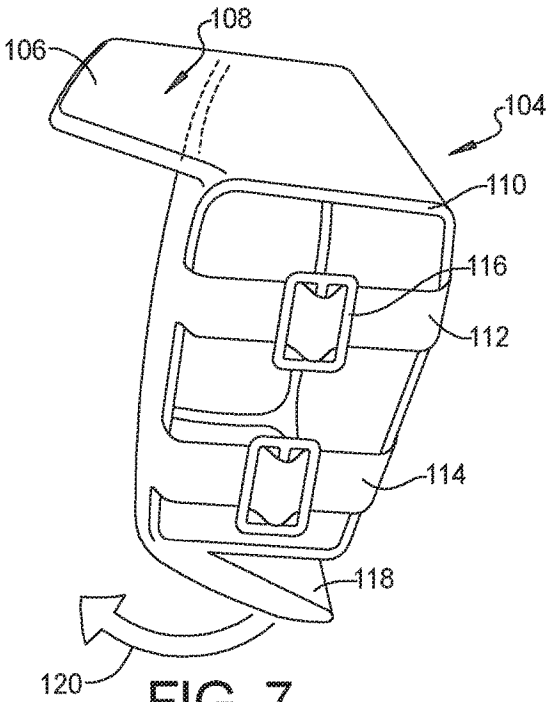
FIG. 7 is a bottom perspective view of an adjustable positioning head restraint speaker system according to another aspect.
Figure 8:
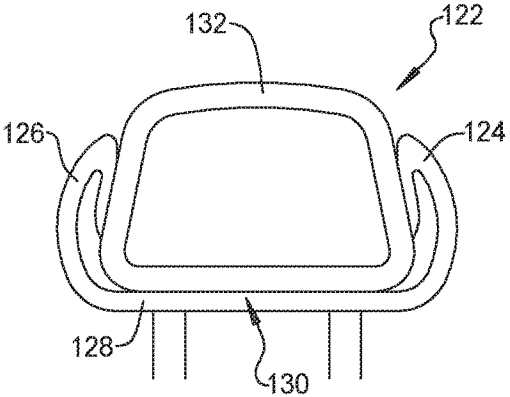
FIG. 8 is a front elevational view of an adjustable positioning head restraint speaker system according to another aspect.

Referring to FIG. 8 and again to FIGS. 1, 6 and 7, according to several aspects an adjustable positioning head restraint speaker system 122 is modified from the adjustable positioning head restraint speaker systems 10, 86 and 104. The adjustable positioning head restraint speaker system 122 provides includes a left-side speaker unit 124 and an opposed right-side speaker unit 126 similar to the previously described speaker units herein, which are both attached to a mounting plate 128. The mounting plate 128 is fixed to a bottom surface 130 of a head restraint 132 which does not require through passages for head restraint posts.

Referring to FIG. 9 and again to FIGS. 1, 6 and 7, according to several aspects an adjustable positioning head restraint speaker system 134 is modified from the adjustable positioning head restraint speaker systems 10, 86, 104 and 122. The adjustable positioning head restraint speaker system 122 provides includes a left-side speaker unit 136 and an opposed right-side speaker unit (not shown) similar to the previously described speaker units herein, which are both attached to a mounting plate 138. The mounting plate 138 is fixed to an upper surface 140 of a seat 142 using fasteners such as a fastener 144. Through passages for head restraint posts can be included or may be omitted from the mounting plate 138.

Figure 9:
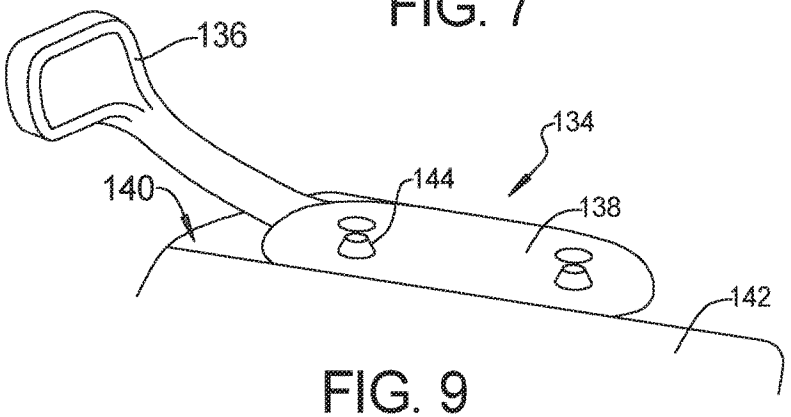
FIG. 9 is a top perspective view of an adjustable positioning head restraint speaker system according to another aspect.

Referring to FIG. 10 and again to FIG. 9, according to several aspects an adjustable positioning head restraint speaker system 146 is modified from the adjustable positioning head restraint speaker systems 10, 86, 104, 122 and 134. The adjustable positioning head restraint speaker system 146 provides the mounting plate 138 of the system 134 fixed to the upper surface 140 of the seat 142, but further provides for each of a rotated speaker unit 148 which can be positioned to provide a first location in direct alignment with an ear of the occupant defining a direct acoustic path 150 toward the head of an occupant and a deflectable speaker unit 152 which can be positioned in a second location for example below, above, in front of or behind the ear of the occupant to provide an indirect acoustic path 154 toward the head of the occupant.

Figure 10:
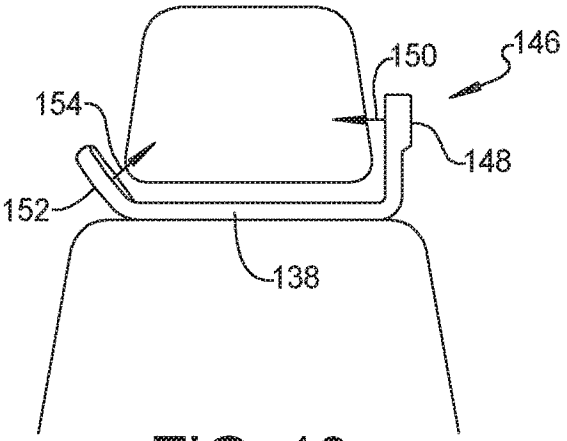
FIG. 10 is a front elevational view of an adjustable positioning head restraint speaker system according to another aspect.

Referring to FIG. 11 and again to FIG. 10, the speaker unit 148 is attached to a rigid speaker support arm 156 which is attached to the mounting plate 138 using a rotating hinge joint 158, thereby allowing the rotated speaker unit 148 to rotate about an arc of rotation 160 which is substantially perpendicular to a plane defined by the mounting plate 138. The deflectable speaker unit 152 is mounted by a flexible arm 162 to the mounting plate 138, which permits the deflectable speaker unit 152 to be moved about an arc of rotation 164 toward and away from the head of the occupant.

Figure 11:
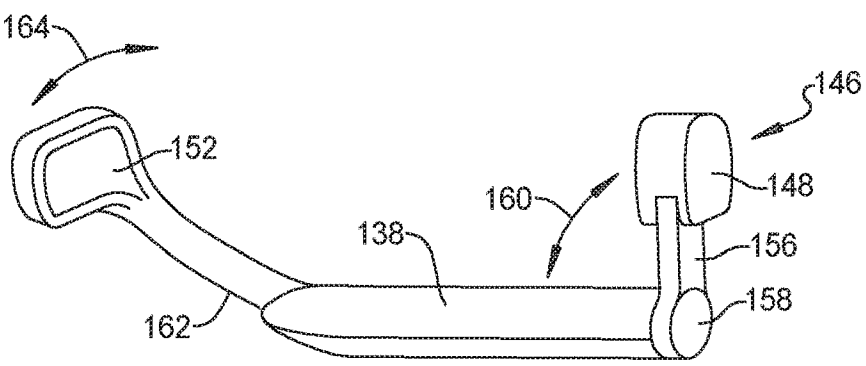
FIG. 11 is a top perspective view of an adjustable positioning head restraint speaker system according to another aspect.
Figure 14:
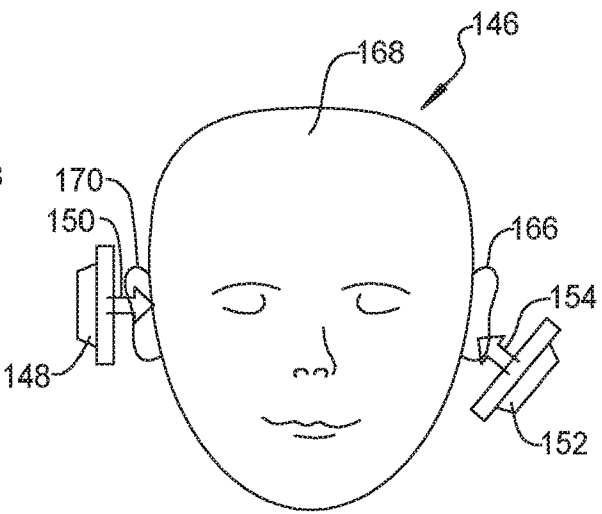
FIG. 14 is a front elevational view of the adjustable positioning head restraint speaker system of FIG. 11.
Figure 13:
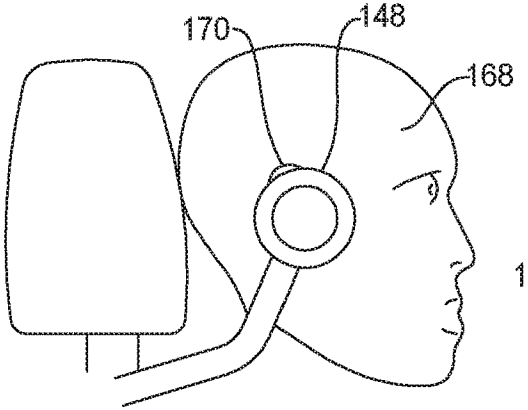
FIG. 13 is a right-side elevational view of the adjustable positioning head restraint speaker system of FIG. 11.
Figure 12:
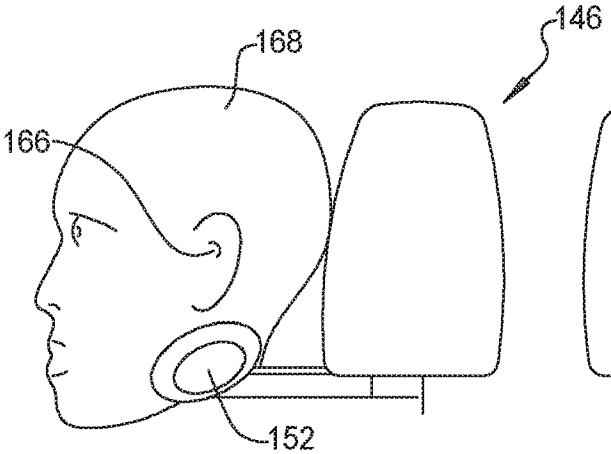
FIG. 12 is a left-side elevational view of the adjustable positioning head restraint speaker system of FIG. 11.

Referring to FIGS. 12, 13 and 14 and again to FIGS. 10 and 11, the deflectable speaker unit 152 is shown in an exemplary position below a left ear 166 of an occupant's head 168. Referring specifically to FIG. 13, the rotated speaker unit 148 is shown in an exemplary position directly aligned with a right ear 170 of the occupant's head 168. Referring specifically to FIG. 14, the position of the deflectable speaker unit 152 provides for the indirect acoustic path 154 toward the head 168 described in reference to FIG. 10 and the position of the rotated speaker unit 148 provides for the direct acoustic path 150 toward the head 168 described in reference to FIG. 10. While the speaker units are shown with respect to the adjustable positioning head restraint speaker system 146, it is noted any of the speaker units of the present disclosure can be oriented in different temporarily fixed locations with respect to any of the head restraint units to provide the direct acoustic path 150 or the indirect acoustic path 154.

As defined herein, direct alignment with the ear referred to by the direct acoustic path 150 defines a position of the speaker unit such as the speaker unit 148 located at the opening of the ear canal, and with the speaker unit 148 oriented substantially parallel with the ear of the occupant and that the acoustic path from the speaker unit 148 leads directly into the ear canal and is oriented substantially perpendicular to an orientation of the ear. As defined herein, indirect alignment with the ear referred to by the indirect acoustic path 154 defines a position of the speaker unit such as the speaker unit 152 positioned away from the opening of the ear canal, and with the speaker unit 152 angularly oriented with respect to the ear of the occupant and that the acoustic path from the speaker unit 152 angularly enters the ear canal and may therefore be degraded or partially disperse prior to entering the ear.

Figure 15:
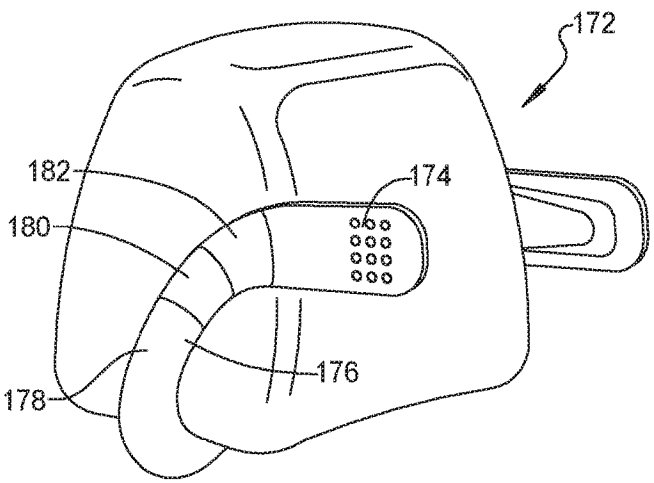
FIG. 15 is a right front perspective view of an adjustable positioning head restraint speaker system according to another aspect.

Referring to FIG. 15, according to several aspects an adjustable positioning head restraint speaker system 172 is modified from the adjustable positioning head restraint speaker systems 10, 86, 104, 122, 134 and 146. The adjustable positioning head restraint speaker system 172 provides opposed, mirror image speaker units therefore the following discussion of a speaker unit 174 applies equally to both speaker units. The speaker unit 174 is mounted at a free end of a multiple segmented arm 176, which includes a first segment 178 connected to a second segment 180, which in turn is connected to a third segment 182. Each of the segments is displaceable with respect to a successive one of the segments. The speaker unit 174 is thereby moveable up and down, front and back, and in and out with respect to the head of the occupant.

Figure 16:
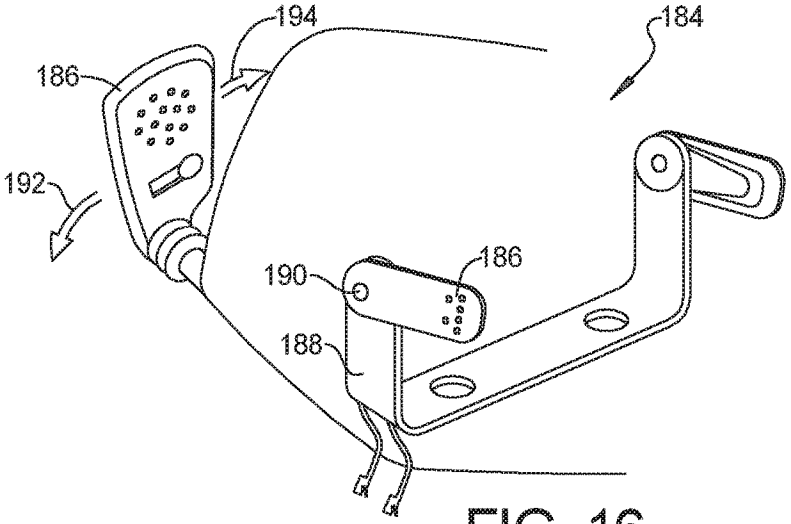
FIG. 16 is a right front perspective view of an adjustable positioning head restraint speaker system according to another aspect.

Referring to FIG. 16, according to several aspects an adjustable positioning head restraint speaker system 184 is modified from the adjustable positioning head restraint speaker systems 10, 86, 104, 122, 134, 146 and 172. The adjustable positioning head restraint speaker system 184 provides a speaker unit 186 which is rotatably mounted to a vertically oriented arm by a pin 190, allowing the speaker unit to rotate in a forward arc of rotation 192 and an opposite rearward arc of rotation 194.

Figure 17:
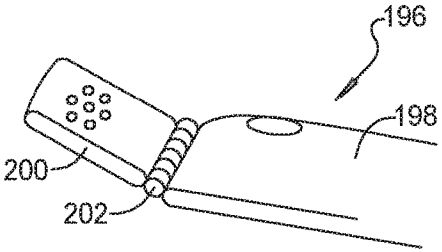
FIG. 17 is a front perspective view of an adjustable positioning head restraint speaker system according to another aspect.

Referring to FIG. 17, according to several aspects an adjustable positioning head restraint speaker system 196 is modified from the adjustable positioning head restraint speaker systems 10, 86, 104, 122, 134, 146,172 and 184. The adjustable positioning head restraint speaker system 196 provides a mounting plate 198 similar to the mounting plate 138 of the system 134 which is fixed to surface of the head restraint unit such as the head restraint unit 18 shown in reference to FIG. 1. The mounting plate 198 is modified from the mounting plate 138 to include a speaker unit 200 rotatably connected by a hinge 202 to the mounting plate 198. The hinge 202 allows the speaker unit 200 to be rotated from a downward and outward stowed position which may lay upon the upper surface (such as the upper surface 140 described in reference to FIG. 9) of a seat up toward the ear and head of the occupant.

Figure 18:
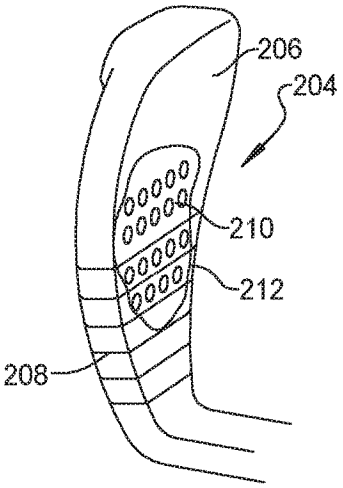
FIG. 18 is a front perspective view of a speaker unit according to another aspect.

Referring to FIG. 18, according to several aspects an adjustable positioning head restraint speaker system 204 is modified from the adjustable positioning head restraint speaker systems 10, 86, 104, 122, 134, 146,172, 184 and 196. The adjustable positioning head restraint speaker system 204 provides a speaker unit 206 mounted to a flexible arm 208. A speaker 210 only partially shown for clarity is positioned at least partially within the flexible arm 208. The flexible arm 208 therefore forms a portion of an air chamber 212 for the speaker unit 206. A speaker grill covering the speaker unit 206 may therefore overlap onto the flexible arm 208.

Figure 19:
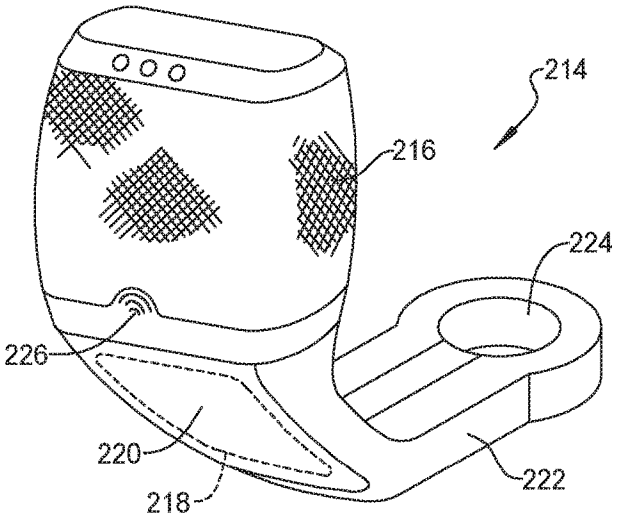
FIG. 19 is a side elevational perspective view of an adjustable positioning head restraint speaker system according to another aspect.

Referring to FIG. 19, according to several aspects an adjustable positioning head restraint speaker system 214 is modified from the adjustable positioning head restraint speaker systems 10, 86, 104, 122, 134, 146,172, 184, 196 and 204. The adjustable positioning head restraint speaker system 214 provides a battery powered speaker unit 216 having a battery 218 (only partially shown for clarity) releasably stored in a battery storage segment 220 formed in a support arm 222. The support arm 222 includes a through aperture 224 sized to slidably receive a head restraint post such as the head restraint post 22 shown and described in reference to FIG. 1. The adjustable positioning head restraint speaker system 214 can therefore be installed by the occupant of the vehicle and rotated about the head restraint post to thereby position the speaker unit 216 as desired. The adjustable positioning head restraint speaker system 214 can also include a control feature 226 to control volume or to control a WiFi function of the unit. According to several aspects, the battery storage segment 220 can be angularly oriented with respect to the support arm 222, with the speaker unit 216 angularly oriented with respect to the battery storage segment 220.

Figure 20:
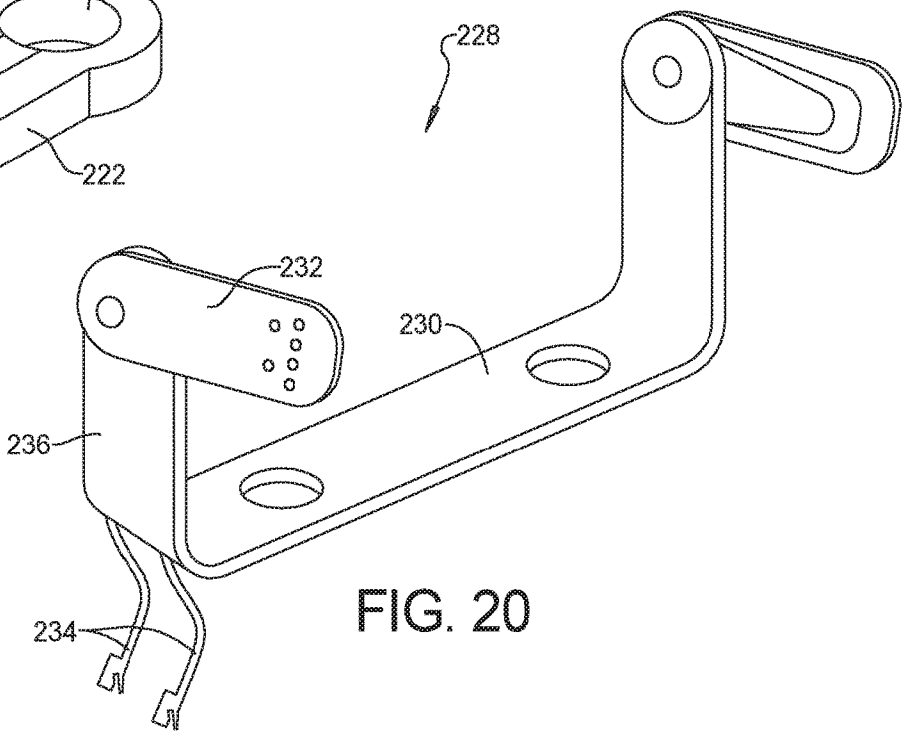
FIG. 20 is a front right perspective view of an adjustable positioning head restraint speaker system according to another aspect.

Referring to FIG. 20, according to several aspects an adjustable positioning head restraint speaker system 228 is modified from the adjustable positioning head restraint speaker systems 10, 86, 104, 122, 134, 146,172, 184, 196, 204 and 214. The adjustable positioning head restraint speaker system 228 provides a mounting plate 230 similar to the mounting plate 138 of the system 134, having speaker unit 232 rotatably connected to a fixed speaker support arm 236 which is fixed to the mounting plate 230. A wiring harness 234 provided by the original equipment manager provides wires for each of speaker power and audio signal transfer. The wiring harness 234 may be connected to and thereby supported by the speaker support arm 236 and directed to the speaker unit 232 from the speaker support arm 236. The wiring harness 234 may be directed through one of the headrest support posts (shown for example in reference to FIG. 1).

Figure 21:
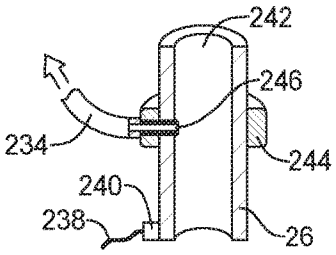
FIG. 21 is a cross sectional front elevational view of an exemplary head restraint post of the present disclosure.

Referring to FIG. 21 and again to FIGS. 1 and 20, an example of how the wiring harness 234 can be routed through one of the head restraint posts, such as the head restraint post 26 is depicted. The wiring harness 234 can include a harness portion 238 which is routed into the head restraint post 26 via a connector 240 fixed to the head restraint post 26 and providing an aperture into the head restraint post 26. The wiring harness 234 is then routed through an interior bore 242 of the head restraint post 26 up to an elevation where a second connector 244 is fixed to the head restraint post 26. The second connector 244 provides an exit aperture 246 through the wall of the head restraint post 26 through which the wiring harness 234 exits.

As an alternative to the above routing path, a similar connector 240 can provide a conductive power transfer having the harness portion 238 power supply connected to the head restraint post 26 via the connector 240. Electrical power is transferred by conduction via the head restraint post 26 and exiting via the connector 246 into wires of the wiring harness 234 to the speaker unit. Using a conductive power transfer in this way wires are not required to be "fed" up the head restraint post 26.

Figure 22:
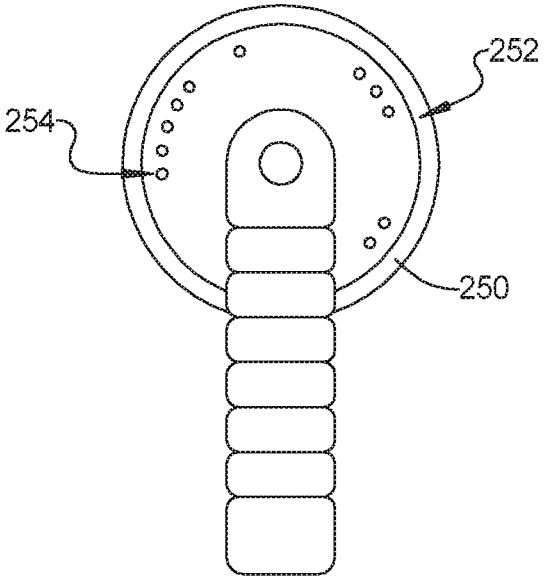
FIG. 22 is a side elevational view of a speaker unit according to another aspect.

Referring to FIG. 22, any one of the speaker units of the present disclosure can also be provided with noise cancellation features. For example a speaker unit 250 includes a noise pick-up area 252 and a noise cancellation area 254.

Figure 23:
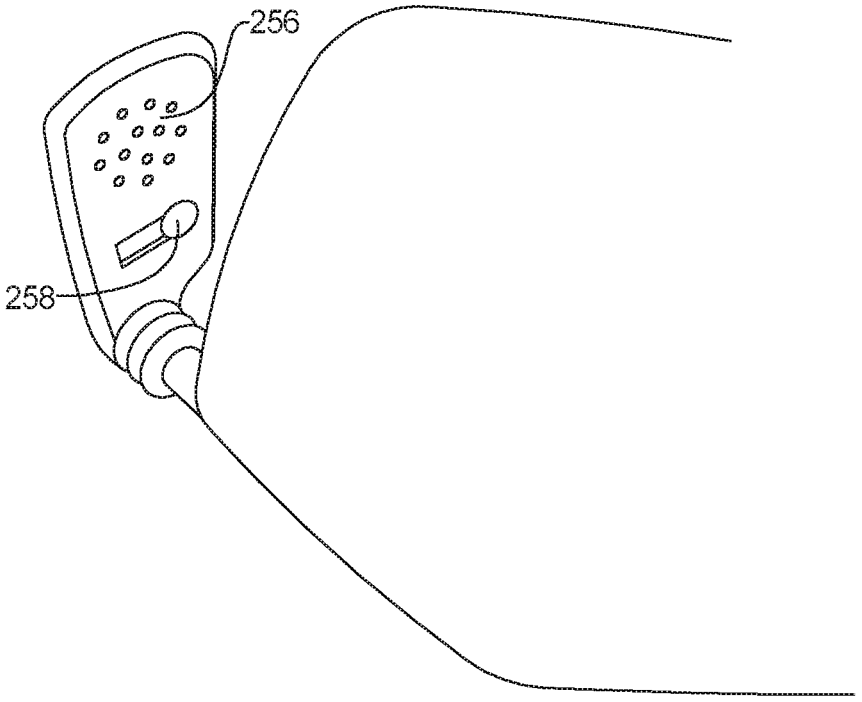
FIG. 23 is a front left perspective view of a speaker unit according to another aspect.

Referring to FIG. 23, any one of the speaker units of the present disclosure can also be provided with local occupant control features. For example, a speaker unit 256 includes a sliding speaker volume control switch 258. The control features can also take other forms, such as a push button, a rotary dial, or the like. The control features can also include features such as WiFi, noise cancellation, power on/off, and the like.

Figure 24:
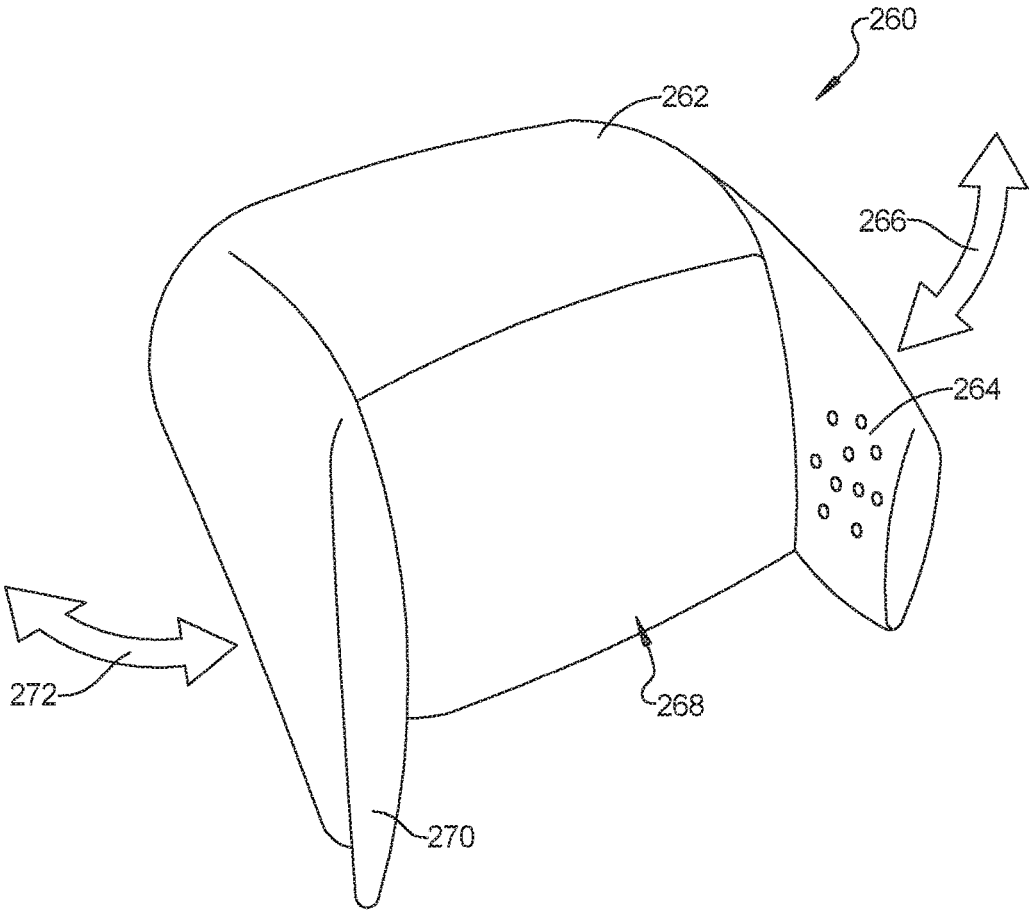
FIG. 24 is a front right perspective view of an adjustable positioning head restraint speaker system according to another aspect.

Referring to FIG. 24, according to several aspects an adjustable positioning head restraint speaker system 260 is modified from the adjustable positioning head restraint speaker systems 10, 86, 104, 122, 134, 146,172, 184, 196, 204, 214 and 228. The adjustable positioning head restraint speaker system 260 is provided with a headrest 262 which can include speaker units positioned in movable wings extending from the headrest 262. These can include a first wing 264 positioned for example at the left-hand side of the occupant's head, which is movable toward the occupant and away from the occupant in an arc of rotation 266. The occupant's head is positioned near or in contact with a front directed face 268 of the headrest 262 with the first wing 264 moved as close as desired by the occupant to the left side of the occupant's head. A second wing 270 is similarly provided at the right-hand side of the occupant's head, which is movable toward the occupant and away from the occupant in an arc of rotation 272. The second wing 270 is moved as close as desired by the occupant to the right side of the occupant's head.

Referring to FIG. 25 and again to FIGS. 1 and 3, in lieu of the lock unit 24, selected speaker units of the present disclosure such as the left-side speaker unit 14 and the right-side speaker unit 16 can be mounted to the head restraint posts, such as a head restraint post 274 using a manual mounted friction unit 276 or a magnetic mounted clamping unit. The manual mounted friction unit 276 can be releasably fixed in place on the head restraint post 274 using a manual slide switch 278.

Figure 25:
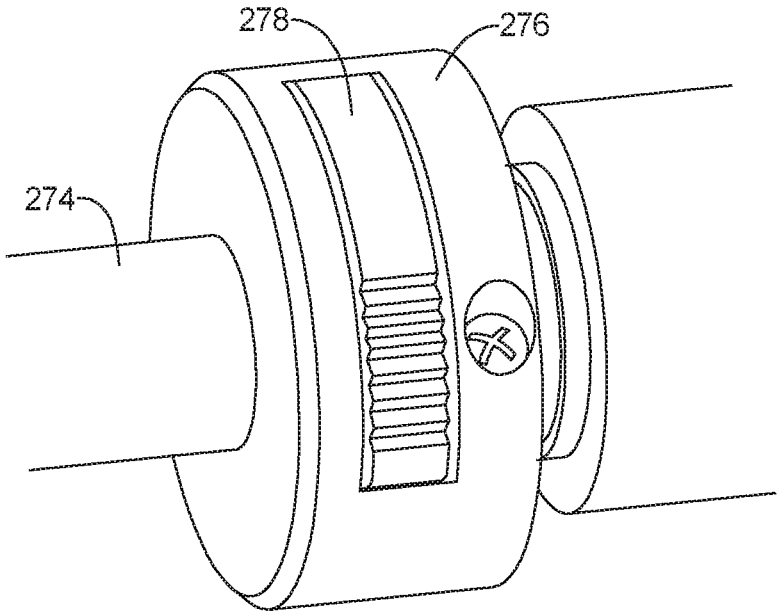
FIG. 25 is a front elevational perspective view of a manual mounted friction unit of the present disclosure.
Figure 26:
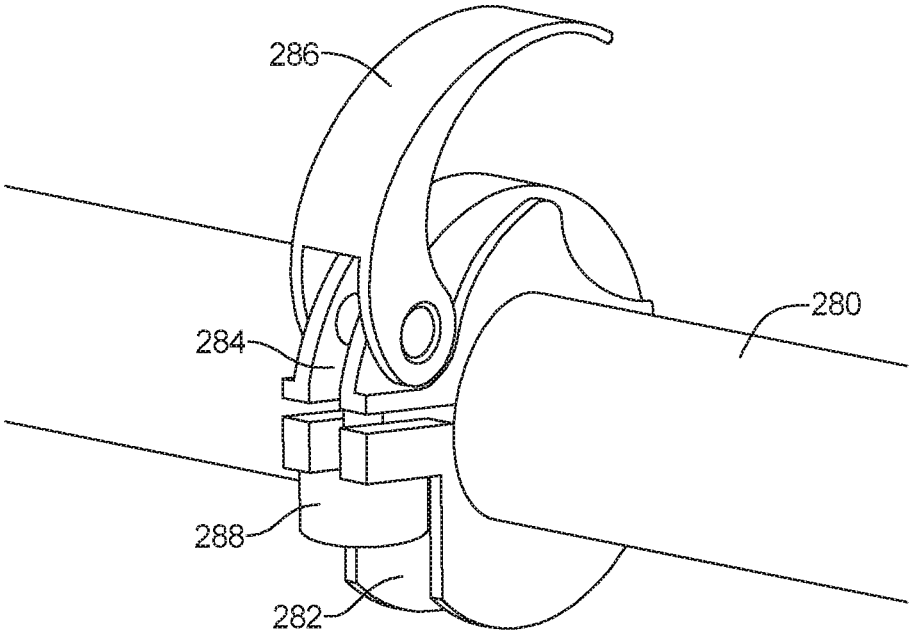
FIG. 26 is a front left elevational perspective view of another manual mounted friction unit of the present disclosure.

Referring to FIG. 26 and again to FIGS. 1, 3 and 25, in lieu of the lock unit 24 or the manual mounted friction unit 276, selected speaker units of the present disclosure such as the left-side speaker unit 14 and the right-side speaker unit 16 can be mounted to the head restraint posts, such as a head restraint post 280 using a cam-operated clamping unit 282. The cam-operated clamping unit 282 provides a camming member 284 engaged using a hand lever 286 to frictionally engage the cam-operated clamping unit 282 to the head restraint post 280. A torque adjustment member 288 can be provided which allows an amount of camming force to be increased or decreased.

Figure 27:
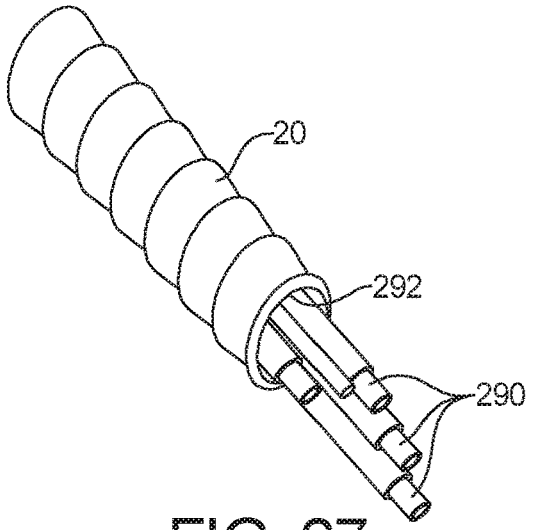
FIG. 27 is a top perspective view of a flexible cable according to the present disclosure.
Figure 28:
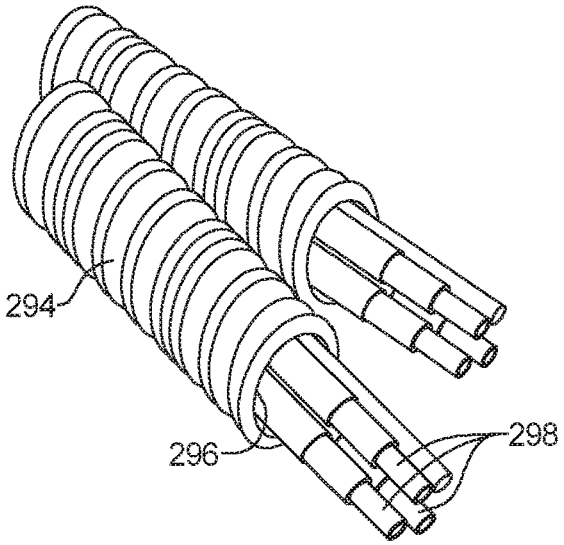
FIG. 28 is a top perspective view of another flexible cable according to the present disclosure.
Figure 29:
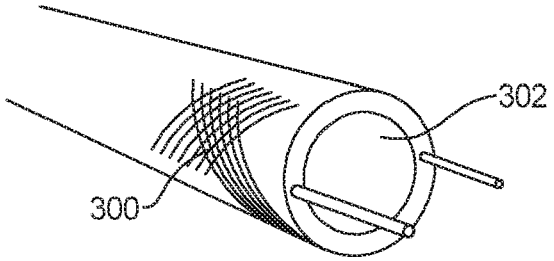
FIG. 29 is a top perspective view of further flexible cable according to the present disclosure.

Referring to FIGS. 27 through 29, the flexible cables of the present disclosure such as flexible cable 20 described in reference to FIG. 1, can be formed of multiple interlocking metal members 292 each connected to a successive member defining a flexible conduit, which provides a hollow passageway for a bundle of wires 290 forming a wiring harness. Similarly, a flexible cable 294 can be formed of multiple interlocking polymeric members each connected to a successive member, which provide a hollow passageway 296 for a bundle of wires 298 forming a wiring harness. A flexible cable 300 can also be provided which is made from an interwoven material such as metal wires or polymeric strands defining an outer body having a hollow passageway 302.

An adjustable positioning head restraint speaker system of the present disclosure offers several advantages. These include provision of individual speaker units on a left-hand and a right-hand side of an occupant's head which are movable to different positions for the listening comfort of the occupant. The speaker units of the present disclosure are independent of the headrest or are independently movable with respect to a headrest of a vehicle seat. The speaker units may be powered by a wiring harness through a head restraint post, connected to a headrest support plate, and through a flexible cable which permits movement of the speaker units independently of the headrest. The present system improves occupant sound quality by creating a customizable audio zone, provides the ability to attach to any headrest or headrest restraint system, and improves the audio surrounding while minimizing impact with occupant vision.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. An adjustable positioning head restraint speaker system, comprising:

a head restraint unit mounted to a vehicle seat; and a speaker unit connected to one of the head restraint unit and the vehicle seat, the speaker unit manually displaced with respect to the head restraint unit to position the speaker unit in different temporarily fixed locations with respect to the head restraint unit, with one of the temporarily fixed locations including a location providing a direct acoustic path into and aligned directly with an ear canal of an occupant of the vehicle seat.

2. The adjustable positioning head restraint speaker system of claim 1, further including a flexible member connecting the speaker unit to the head restraint unit.

3. The adjustable positioning head restraint speaker system of claim 2, wherein the head restraint unit is mounted to the vehicle seat using a head restraint post; and wherein the flexible member is releasably engaged to the head restraint post using a lock unit.

4. The adjustable positioning head restraint speaker system of claim 3, wherein the lock unit includes a mechanical member engaging the lock unit to the head restraint post.

5. The adjustable positioning head restraint speaker system of claim 3, wherein the lock unit is movable in each of a first direction and an opposite second direction along the head restraint post independently of movement of the head restraint post.

6. The adjustable positioning head restraint speaker system of claim 2, wherein the flexible member defines a flexible cable having a hollow passageway through which a wiring harness extends, the wiring harness providing power and acoustic signals to the speaker unit.

7. The adjustable positioning head restraint speaker system of claim 2, wherein the flexible member defines a multiple segmented arm, with a speaker of the speaker unit positioned at least partially within the arm, and having the arm defining a portion of an air chamber of the speaker.

8. The adjustable positioning head restraint speaker system of claim 2, wherein the flexible member defines a hinge connected to a mounting plate, the mounting plate connected to a surface of the head restraint unit.

9. The adjustable positioning head restraint speaker system of claim 1, wherein the speaker unit slidably manually extends forward and rearward with respect to a speaker housing, the speaker housing connected by a strap to the head restraint unit to fix the speaker housing on a side of the head restraint unit such that the speaker unit when extended from the speaker housing is positioned proximate to an ear of an occupant of the vehicle seat.

10. The adjustable positioning head restraint speaker system of claim 1, wherein the speaker unit defines a speaker flap connected to an envelope cover, wherein the envelope cover extends around the head restraint unit and is releasably connected to the head restraint unit using at least one strap, the speaker flap moving between a stored position to an extended listening position.

11. The adjustable positioning head restraint speaker system of claim 1, wherein the speaker unit includes at least one local occupant control feature for control of at least one of an audio volume, and an on/off function.

12. The adjustable positioning head restraint speaker system of claim 1, wherein the speaker unit includes a battery storage segment having a battery providing power for operation of the speaker unit.

13. An adjustable positioning head restraint speaker system, comprising:

a head restraint unit mounted to a vehicle seat;

a first speaker unit and a second speaker unit each manually displaced with respect to the head restraint unit to independently position each of the first speaker unit and the second speaker unit in different temporarily fixed locations with respect to the head restraint unit, with one of the temporarily fixed locations including a location providing a direct acoustic path into and aligned directly with an ear canal of an occupant of the vehicle seat;

a support member connecting the first speaker unit and the second speaker unit to one of the head restraint unit and the vehicle seat; and a power supply providing power to the first speaker unit and the second speaker unit the support member.

14. The adjustable positioning head restraint speaker system of claim 13, wherein the first speaker unit and the second speaker unit are connected to a mounting plate which is fixed to a bottom surface of the head restraint unit.

15. The adjustable positioning head restraint speaker system of claim 13, wherein the first speaker unit and the second speaker unit are connected to a mounting plate which is fixed to an upper surface of the vehicle seat.

16. The adjustable positioning head restraint speaker system of claim 13, wherein the power supply defines a wiring harness providing wires for each of speaker power and audio signal transfer, the wiring harness at least partially supported by the support member.

17. The adjustable positioning head restraint speaker system of claim 13, wherein the power supply defines a battery locally stored in at least one of the first speaker unit and the second speaker unit.

18. An adjustable positioning head restraint speaker system, comprising:

a head restraint unit mounted to a vehicle seat;

a left-side speaker unit and a right-side speaker unit each manually displaced with respect to the head restraint unit to independently position each of the left-side speaker unit and the right-side speaker unit in different temporarily fixed locations with respect to the head restraint unit; and a member connecting the left-side speaker unit and the right-side speaker unit to one of the head restraint unit and the vehicle seat;

wherein the different temporarily fixed locations include at least a first location creating a direct acoustic path into an ear canal of an occupant of the vehicle seat and a second location defining an indirect acoustic path toward the ear canal of the occupant.

19. The adjustable positioning head restraint speaker system of claim 18, further including:

at least one head restraint post connecting the head restraint unit to the vehicle seat; and a flexible member connecting the speaker unit to the head restraint post;

wherein the flexible member defines a flexible cable having a hollow passageway through which a wiring harness extends, the wiring harness providing power and acoustic signals to the speaker unit.

20. The adjustable positioning head restraint speaker system of claim 19, wherein the wiring harness extends through the head restraint post to a connector fixed to the head restraint post, the connector providing an exit aperture through a wall of the head restraint post through which the wiring harness extends into the hollow passageway of the flexible member.

* * * * *